US010408576B2

(12) United States Patent
Lorenzo et al.

(10) Patent No.: US 10,408,576 B2
(45) Date of Patent: Sep. 10, 2019

(54) HIGH-ENERGY IMPACT ABSORBING POLYCARBONATE MOUNTING METHOD

(75) Inventors: James M. Lorenzo, Mars, PA (US); Robert A. Pyles, Bethel Park, PA (US); Raymond L. Goodson, Sandy, UT (US)

(73) Assignee: PLASKOLITE MASSACHUSETTS, LLC, Columbus, OH (US)

( * ) Notice: Subject to any disclaimer, the term of this patent is extended or adjusted under 35 U.S.C. 154(b) by 1149 days.

(21) Appl. No.: 12/258,698

(22) Filed: Oct. 27, 2008

(65) Prior Publication Data

US 2010/0101404 A1 Apr. 29, 2010

(51) Int. Cl.

| | |
|---|---|
| ***F41H 5/00*** | (2006.01) |
| ***F41H 5/24*** | (2006.01) |
| ***F41H 5/04*** | (2006.01) |
| ***F41H 5/26*** | (2006.01) |
| ***E04H 9/10*** | (2006.01) |
| ***F41H 5/013*** | (2006.01) |

(52) U.S. Cl.

CPC ..... *F41H 5/24* (2013.01); *E04H 9/10* (2013.01); *F41H 5/013* (2013.01); *F41H 5/0407* (2013.01); *F41H 5/263* (2013.01)

(58) Field of Classification Search

USPC ..... 89/36.01, 36.04, 36.07; 109/10, 12, 21.5

See application file for complete search history.

(56) References Cited

U.S. PATENT DOCUMENTS

| | | | | |
|---|---|---|---|---|
| 3,191,728 | A | 6/1965 | David | |
| 3,520,768 | A | 7/1970 | Peilstöcker et al. | |
| 3,624,238 | A | 11/1971 | McKenzie | |
| 3,666,614 | A | 5/1972 | Snedeker et al. | |
| 4,625,659 | A | 12/1986 | Saelzer | |
| 4,642,255 | A | 2/1987 | Dlubak | |
| 5,142,997 | A * | 9/1992 | DeLong et al. | 109/49.5 |
| 5,668,344 | A | 9/1997 | Bornstein | |
| 5,765,325 | A | 6/1998 | DeBlock | |
| 5,771,489 | A * | 6/1998 | Snedeker | 2/2.5 |

(Continued)

FOREIGN PATENT DOCUMENTS

| | | |
|---|---|---|
| EP | 0958975 A1 | 11/1999 |
| FR | 2740211 A1 | 4/1997 |

(Continued)

OTHER PUBLICATIONS

U.S. Appl. No. 11/983,980, filed Nov. 13, 2007 (not yet published), James A. Lorenzo et al, Blast-Resistant Barrier.

*Primary Examiner* — J. Woodrow Eldred

(74) *Attorney, Agent, or Firm* — Vorys, Sater, Seymour and Pease LLP; Brigid E. Sharek

(57) ABSTRACT

The present invention provides a bi-active method of mounting a monolithic polycarbonate sheet or a laminate in a semi-rigid metallic framing system along two parallel sides of a rectangular shaped sheet or laminate with the two shorter parallel sides being unconstrained. In the case of a square shaped sheet, two parallel sides are supported in the semi-rigid frame, and the other two parallel sides are unconstrained. The semi-rigid frame utilizes cylindrically shaped hardware (i.e., bolts, rivets, studs, etc.) to hold the sheet or laminate. The semi-rigid frame is designed, via section and material properties, to flex and hinge about fixed mounting points along the length of the frame.

23 Claims, 7 Drawing Sheets

(56) References Cited

U.S. PATENT DOCUMENTS

| | | | | |
|---|---|---|---|---|
| 5,802,783 | A | 9/1998 | Bayha | |
| 6,177,368 | B1 | 1/2001 | Fisher | |
| 6,266,926 | B1 | 7/2001 | Figge et al. | |
| 6,349,505 | B1 | 2/2002 | Figge et al. | |
| 6,622,607 | B1 * | 9/2003 | Miller | 89/36.07 |
| 6,767,158 | B1 | 7/2004 | Consolazio et al. | |
| 7,144,186 | B1 | 12/2006 | Nolte | |
| 7,493,844 | B2 * | 2/2009 | Martin | 89/36.07 |
| 7,914,069 | B2 | 3/2011 | Barbe et al. | |
| 2004/0226231 | A1 | 11/2004 | Dlubak | |
| 2004/0261332 | A1 | 12/2004 | Nanayakkara | |
| 2007/0011962 | A1 | 1/2007 | Erskine | |
| 2008/0016794 | A1 | 1/2008 | Tremblay et al. | |
| 2008/0190278 | A1 | 8/2008 | Martin | |
| 2008/0196317 | A1 | 8/2008 | Duncan et al. | |
| 2011/0048219 | A1 | 3/2011 | Pyles et al. | |

FOREIGN PATENT DOCUMENTS

| | | | |
|---|---|---|---|
| JP | 2005241183 | A | 9/2005 |
| JP | 2009270648 | A | 11/2009 |
| WO | 03052229 | A1 | 6/2003 |
| WO | 2005000577 | A2 | 1/2005 |
| WO | 2008103989 | A1 | 8/2008 |

* cited by examiner

HIGH-ENERGY IMPACT ABSORBING POLYCARBONATE MOUNTING METHOD

FIELD OF THE INVENTION

The present invention relates to a method of mounting a blast-resistant barrier such as a barrier comprising at least one high energy impact absorbing polycarbonate panel.

BACKGROUND OF THE INVENTION

Government and commercial buildings (e.g., embassies, court houses, hotels, casinos, malls, airports and stadiums) have proven attractive targets for bombing attacks throughout the world in recent years. The attacker, in most cases, is a politically motivated terrorist using, as a weapon, a high explosive device transported and detonated inside a vehicle nearby the targeted building. The explosive device carried in such vehicles is typically capable of generating a shock wave of sufficient force as to shear the face off unprotected buildings, leading to tremendous loss of life and property damage. The resulting debris field surrounding the building is often several feet thick blocking entrances. In addition, glass remnants dangle precariously, potentially falling from great heights to the ground in the slightest breeze. Consequently, both hazards hinder and threaten the safety of emergency response teams as they attempt to enter the damaged building to render aid to the injured.

The simplicity and stealth of vehicular weapons make them a complex foe. It is virtually impossible to screen all the cars and trucks that rumble past critical buildings. Defending against such an explosive device involves keeping vehicles at a distance from vulnerable targets, often using Jersey barriers, blocks, bollards and other concrete structures (See e.g., U.S. Pat. Nos. 7,144,186 and 6,767,158, and U.S. Published Patent Application No. 2004/0261332). However, this can be difficult where public roads pass immediately outside these structures. Closure of roads, or protecting buildings with concrete barriers is not always practical, as it can often be unsightly and is therefore generally undesirable.

Existing buildings rarely have blast resistant construction and thus much emphasis has been placed on retrofits for windows to mitigate glass hazards. The use of so-called safety glazing or penetration-resistant glazing for windows, using multiple layers of polycarbonate, glass, and other resinous materials is well known. For example, glass-polycarbonate resin laminates adhering together with ethylene-vinyl copolymers are described in U.S. Pat. No. 3,666,614. In U.S. Pat. No. 3,520,768, there are described laminates of relatively thick glass having a comparatively thin polycarbonate foil as the adhering material. U.S. Pat. No. 3,624,238 concerns a bullet resistant laminated structure that includes outer faces or plies of safety glass with an intermediary ply formed of a polycarbonate resin.

U.S. Pat. No. 6,266,926 describes a flexible apparatus that is deployed by inflating a protective barrier adjacent to windows to reduce the quantity of debris hazard in the event of an explosion. U.S. Pat. No. 6,349,505 discloses a louver system mounted adjacent to the inside and/or outside of a glass window and reinforced using high elongation cables or straps attached to the floor and ceiling. The louver system would immediately close upon detection of an explosion, reducing the quantity of debris hazard in the building.

U.S. Pat. No. 4,625,659 discloses a bullet and explosion proof window or door system comprising two spaced apart panels, whereby the outer panel is spaced from a support soffit such that a gap is formed for providing a ventilation channel. However, peripheral portions of the panels are fitted with a security layer in order to prevent projectiles from entering through the ventilation gap. U.S. Pat. Nos. 6,177,368 and 4,642,255 discloses blast-resistant panels produced from PVC and woven fiberglass, and polyvinyl acetal, glass and a fibrous layer encapsulated in the polyvinyl acetal layer. U.S. Pat. No. 3,191,728 discloses a barrier consisting of welded metal strips, as protection for workers in aircraft parking areas from the exhaust of jet engines.

U.S. Published Patent Application No. 2007/0011962 discloses a transparent assembly locatable in a building surface having a rebate. The assembly has a transparent panel and one or more high tensile strength flexible material reinforcement pieces extending laterally from the panel to provide non-rigid attachment of the assembly to a subframe and/or wall. The attachment is said to allow movement of the assembly within the rebate. By direct but non-rigid attachment of the transparent assembly, generally a window, to the subframe and/or wall, any weakness in the impact-resistance of the assembly because of weakness and/or damage to the frame is said to be avoided. The non-rigid nature of the attachment is said to allow it to absorb much of the blast loading which in turn is said to allow a large load on the transparent assembly to be supported by the subframe and/or wall.

A self-centering energy dissipative brace apparatus with tensioning elements is described in U.S. Published Patent Application No. 2008/0016794.

U.S. Published Patent Application No. 2004/0226231 provides a blast resistant assembly for use as a window, door, or the like, that is capable of withstanding a bomb blast, hurricane, tornado, or other strong force. The assembly includes a composite panel that comprises a glass sheet bonded to a polymeric layer, and a frame that surrounds the composite panel. In the event of an explosion or other strong force, the composite panel is secured within the frame by one or more retainers. Each retainer includes an extension that is embedded within the polymeric layer. The composite panel may also be pivotally mounted to the frame to facilitate deflection of the composite panel during a blast, and to provide a means for emergency exit.

In U.S. patent application Ser. No. 11/983,980, the present inventors present a blast-resistant barrier comprising a plurality of units each including a panel having a thickness of greater than 20 to less than 40 millimeter. The panel is in the form of a monolithic polycarbonate sheet or a laminate positioned vertically between the source of a blast and the blast target, the laminate including at least two polycarbonate sheets and an optional image layer interposed therebetween. The panel is fixedly attached to a frame which is firmly embedded in concrete in a manner calculated to provide stiffness sufficient to absorb and withstand external forces resulting from the blast.

Retrofits to protect building facades have traditionally involved strengthening of walls. To be truly effective, wall-strengthening is often an invasive operation which adversely affects the appearance of the structure and impacts building operations. It is, therefore, desirable to have a structure that is unobtrusive, easy to install, and at the same time protective of the entire building from the devastating effects of a vehicular bombing attack.

SUMMARY OF THE INVENTION

The present invention involves a bi-active method of mounting a monolithic polycarbonate sheet or a laminate in a semi-rigid metallic framing system along two parallel sides of a rectangular shaped sheet or laminate with the two shorter parallel sides being unconstrained. In the case of a square shaped sheet, two parallel sides are supported in the semi-rigid frame, and the other two parallel sides are unconstrained. The semi-rigid frame utilizes cylindrically shaped hardware (i.e., bolts, rivets, studs, etc.) to hold the sheet or laminate. The semi-rigid frame is designed, via section and material properties, to flex and hinge about fixed mounting points along the length of the frame.

This inventive method allows polycarbonate sheet or laminate to be used in high energy impact applications such as blast-mitigating building facades/windows and hurricane resistant panels.

These and other advantages and benefits of the present invention will be apparent from the Detailed Description of the Invention herein below.

BRIEF DESCRIPTION OF THE FIGURES

The present invention will now be described for purposes of illustration and not limitation in conjunction with the figures, wherein.

DETAILED DESCRIPTION OF THE INVENTION

The present invention will now be described for purposes of illustration and not limitation. Except in the operating examples, or where otherwise indicated, all numbers expressing quantities, percentages, and so forth in the specification are to be understood as being modified in all instances by the term "about."

The present invention provides a method of mounting a blast-resistant barrier involving attaching the barrier to a semi-rigid metallic frame along a first two parallel sides of the barrier with a second two parallel sides being unconstrained, wherein the barrier is from 0.375 inches to 1.5 inches in thickness and includes at least one polycarbonate sheet.

Referred to here as a bi-active framing method, the inventive method implies that the mounts are active (or flexing) in a biaxial or two sided mode, while the other two sides are not active (or flexing during an impact event acting on the face of the system).

The sheet or laminate useful in the inventive method may optionally include at least one image layer in the form of wood, stone, glass, textile, metal, paper, plastic, plants, flowers or vegetation and their products and each of these may be of any color. The image layer may be laminated to or between any two of the layers. The thickness of the sheet or laminate is in the range of 20 to 40 millimeters.

In the embodiment where the barrier is a laminate it is preferred that it includes a first polycarbonate sheet 10 to 20, preferably 12-18 millimeter (mm) in thickness, a second polycarbonate sheet 10 to 20, preferably 12-18 mm in thickness and at least one image layer interposed between the first and second sheets. Other embodiments entail a plurality of polycarbonate sheets, typically three of four sheets of identical thicknesses or differing thicknesses.

Figure 3:
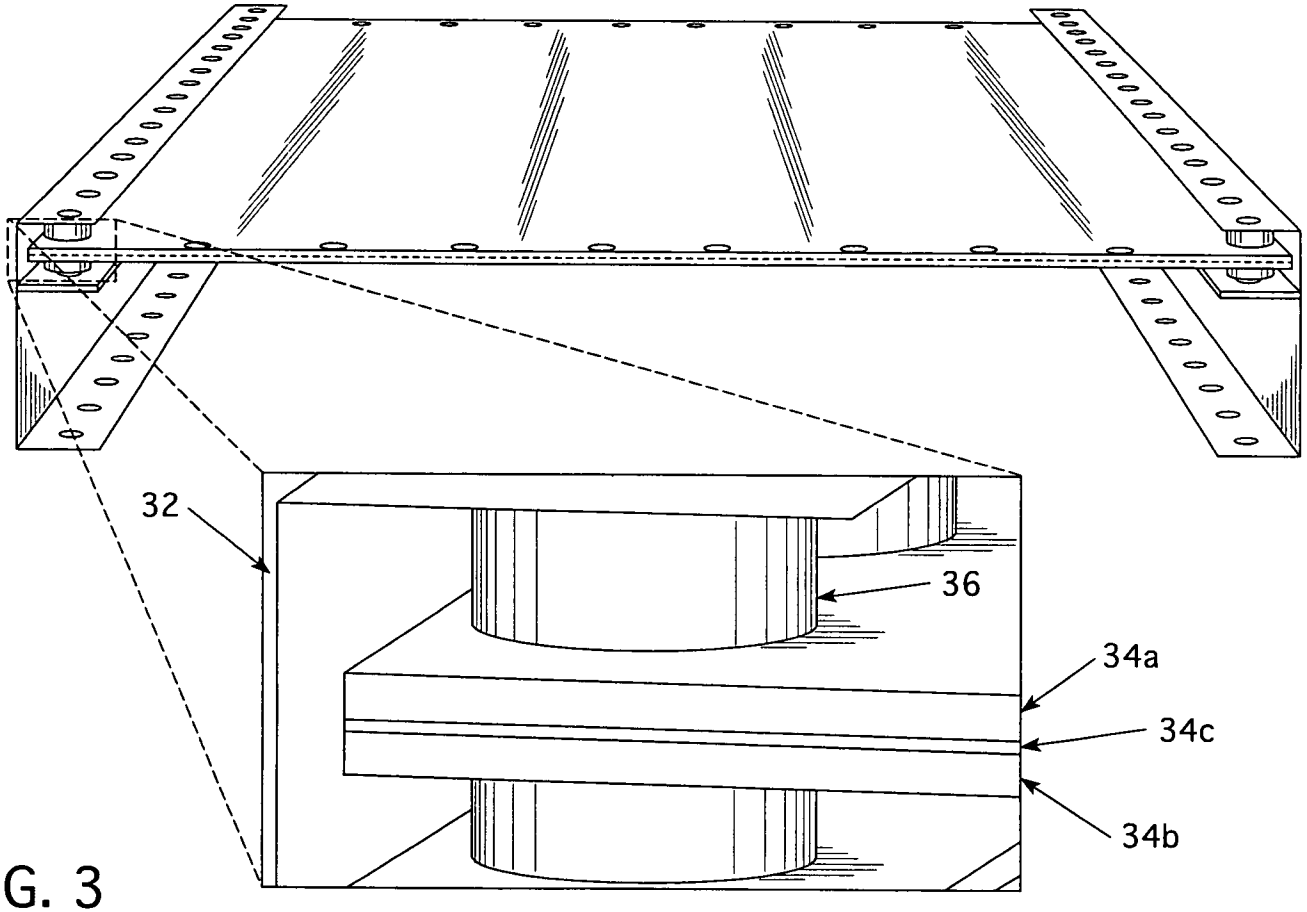
FIG. 3 shows an enlarged view of the connection used in the inventive method.

The several sheets making up the laminate (FIGS. 3, 34*a* and 34*b*) may be bonded one to the other by lamination or by the use of an adhesive. A suitable adhesive layer includes 0.025" thick A4700 DUREFLEX thermoplastic polyurethane film, a product of Deerfield Urethane (FIG. 3, 34*c*). It is imperative that the adhesive be sufficiently heat resistant to withstand the thermal conditions encountered in lamination without degradation and distortion. Naturally, in circumstances where transparency of the barrier is desired, the adhesive must be transparent.

In one embodiment of the invention, the laminate may be prepared by (a) providing a first polycarbonate sheet having a thickness of 10 to 20 mm; and (b) providing a second polycarbonate sheet having a thickness of 10 to 20 mm; and (c) placing at least one image layer between the first and second sheets to form a sandwiched structure and (d) pressing the structure at elevated temperature for a time sufficient to form a laminate. Suitable thermal conditions are generally 18 to 249° C., preferably 32 to 227° C. under pressure of 69 to 2069, preferably 448 to 662 kPa, for a time at maximum temperature and pressure of 0.1 to 20 preferably 0.1 to 5 most preferably 0.17 to 3 minutes. Temperatures exceeding 249° C. and pressures exceeding 2070 kPa are undesirable in hot press bonding since the sheet layers may squeeze out of the aligned image layer. It is preferred to apply pressure before the application of heat. Optionally the laminate thus formed may be cooled at pressure between 7 and 2065 kPa. In yet an additional embodiment the inventive laminate further includes a protective hard-coat layer.

Importantly, the first and second sheets are not necessarily the outermost sheets of the laminate useful in the present invention. As noted above the laminate may contain a plurality of sheets (layers) on each side of the image layer as well as several image layers. It is however preferred that the total thickness of the barrier be from 0.375 to about 1.5 inches. The laminate is preferably 4 feet wide and 8 feet long but these are not limiting dimensions.

The polycarbonate sheets independently may be transparent, translucent, or opaque. Moreover the sheets may differ one from the others in their respective degrees of transparency or translucency and color.

Polycarbonate is well known thermoplastic, aromatic polymeric resin (see German Offenlegungsschriften 2,063,050; 1,561,518; 1,570,703; 2,211,956; 2,211,957 and 2,248,817; French Patent 1,561,518; and in particular the monograph by H. Schnell, "Chemistry and Physics of Polycarbonates", Interscience Publishers, New York, N.Y., 1964, which is incorporated herein by reference). The polycarbonate suitable in the context of the invention has weight average molecular weight of 8,000 to 200,000, preferably up to 80,000 and an intrinsic viscosity of 0.40 to 1.5 dl/g as measured in methylene chloride at 25° C. Preferably, the glass transition temperature of polycarbonates ranges from 145 to 148° C.

Polycarbonate sheets suitable in the context of the invention are available in commerce. Preferable for their good mechanical properties and excellent transparency are sheets made of a homopolycarbonate based on bisphenol A. Such suitable sheets are available under the MAKROLON trademark from Sheffield Plastics Inc.; a Bayer MaterialScience company.

The image layer(s) preferably includes fabric, metallic wire, rod and/or bar, papers or photographic images, and vegetation, such as grasses, flowers, wheat, and thatch. The image layer may display images or designs or may be of a solid color and should be sufficiently thermally resistant, e.g. of sufficiently high melt temperature to avoid any degradation or distortion of the image during the manufacture or processing of the barrier. Preferably, the image layer(s) are substantially continuous. The thickness of the image layer is preferably 0.0254 to 1.524 mm, more preferably 0.0254 to 0.05 mm, and is most preferably 0.04 mm. However, polymeric films thinner or thicker may be used in the decorative image layer depending on the equipment available, and under such conditions the thickness is limited only by functionality.

In a preferred embodiment, the laminate includes at least one first image layer positioned between the first and the second polycarbonate sheet and at least one second image layer positioned between the second and the third polycarbonate sheet.

In one embodiment of the present invention, the image layer comprises a fabric of textile fibers. The fabric may display images or designs produced, e.g., by weaving or knitting techniques, in the fabric. The fabrics may be textile fibers, (i.e., fibers of natural-occurring, semi-synthetic or synthetic polymeric materials). For example, the fabrics may be prepared from cotton, wool, silk, rayon (regenerated cellulose), polyester such as polyethylene terephthalate, synthetic polyamides such as nylon 66 and nylon 6, acrylic, methacrylic, and cellulose acetate fibers. The melting point of the textile fibers should be sufficiently high to avoid any degradation or distortion of the fabric during the manufacture or processing of the laminate of the invention.

The fabric may be woven, spun-bonded, knitted, or prepared by other processes well known in the textile trade and may be uncolored, e.g., white, or colored by conventional dyeing and printing techniques. Alternatively, the fabrics may be produced from dyed yarn or from filaments and yarn derived from mass colored polymers. Preferably, the fabrics present within the decorated laminate structure are substantially continuous and constitute a distinct image layer or laminate.

In an embodiment of the invention, the image layer comprises metallic wire, rod, or bar. The metal wire may be formed by a variety of techniques to produce metal mesh fabric, screens, or open mesh having high transparency. The metal wire, rod or bar may be woven, welded, knitted, or fabricated by means of other processes well known in the metal wire fabrication art. The metallic wire, rod and bar may be of any color. The metallic element of the image layer may be of different metallic materials such copper, aluminum, stainless steel, steel, galvanized steel, titanium, etc. or combinations thereof. The metallic component of the image layer may be prepared from wire filaments, rods and bars having various cross-sectional areas and geometries, e.g., generally circular, oval or relatively flat. The thickness or diameter of the wire, rod and bar is not critical. It is however critical that the metallic surfaces are smooth so as avoid creating of propagating cracks that may weaken the barrier. Hence, embedding the metallic surfaces in a polymeric material, such as polyvinyl chloride, copolyester or polyurethane, may be advantageous. The only requirement relative to this embodiment is that the embedding polymeric materials have sufficient heat resistance so as not to be thermally degraded or distorted by the lamination and forming processes.

In an additional embodiment, the laminate may comprise an image layer of wire, rod, or bar that reinforce the polycarbonate. In further embodiment, the image layer comprises a printed or colored image. Preferably, the printed or colored image layer has opposed surfaces wherein an image is printed on one of the surfaces and/or the decorative image layer contains coloration. More than one printed or colored decorative image layer may be used in the decorated laminate structure of the present invention. The use of multiple decorative image layers may provide a three-dimensional or "floating" appearance to the decorative images or lettering in the printed or colored image layers. Each of the printed or colored image layers is joined to a first sheet on one of its surfaces such that the image or coloration may be viewed through the first sheet without significant distortion. The printed or colored image layer may comprise any suitable polymeric material which is compatible with the materials used for the first and second sheets, inks, or other materials used in fabricating the laminate. Preferably, the image layer comprises polyvinylchloride, copolyester, polycarbonate or polyurethane thermoplastic.

In another embodiment, the image or coloration is printed on the bottom side of the image layer in which case the polymer used to prepare the image layer is transparent.

The printed image may be prepared according to conventional photographic printing processes or with a digitized database generated from a photographic image. Digitizing and storing the image may be accomplished through any of a number of processes well known in the computer art such as scanning.

In yet another embodiment, the image layer comprises vegetation, such as grasses, thatch, flowers, for example rose petals, wheat, grains, natural papers and others, such that the natural color of vegetation is preserved. More than one image layer comprising vegetation may be used in the decorated laminate structure of the present invention. The use of multiple image layers may provide a three-dimensional or "floating" appearance to the decorative vegetation in the image layers. Each of the image layers is joined to a first sheet on one of its surfaces such that the vegetation can be seen through the first sheet without significant distortion.

The laminate structure may optionally comprise a protective hard-coat layer, which is a transparent, hard, scratch-resistant or abrasion resistant coating or layer laminated to the top surface of the first sheet. Such coating may also increase the chemical resistance of the laminate and provide an anti-graffiti surface. The protective layer may be a bi-layer film comprising a protective layer on top of a sheet layer. The protective layer is preferably selected from the UV-cured or electron-beam-cured crosslinked acrylic, vacuum-cured or UV-cured urethane, UV-cured or electron-beam-cured silicon with acrylic or heat cured urethane or plastisol. A layer of polyurethane may be applied over the exterior surface to provide abrasion resistance. Alternatively, a biaxially oriented polyethylene terephthalate, (MYLAR) or a polytetrafluoroethylene film (TEFLON), or a polyvinyl fluoride film (TEDLAR), all available from DuPont Chemical Company, may be laminated to the top surface of the first sheet as a protective layer to act as an anti-graffiti surface. More preferably, the protective layer comprises a thermal-cured, UV-cured or electron-beam-cured silicon to achieve glass appearance.

Lamination of the inventive barrier useful in the present invention is conventional. In one laminating method, a plywood laminating press that features efficient heat transfer and even distribution of heat is preferably used. To augment the reduction in pressure, a vacuum may be applied in order to remove trapped air between the layers. During the bonding process, if necessary, the polycarbonate materials may be bonded or fused together with the use of adhesive.

Preferably, the laminating method comprises hot press bonding or cold press bonding. As is well known, hot press bonding methods include, but are not limited to, hot steam, electric heat, hot oil heated and other methods known in the art. Cold press bonding methods include, but are not limited to, cold water and glycol cooled method. The lamination may be performed either with or without a vacuum press. Generally, the formation of bubbles in the laminate is less likely if the air is evacuated prior to applying heat and pressure. In any event, it is critical that sufficient pressure is applied to rid the system of air prior to bonding. Following the hot press bonding, the bonded structure is allowed to cool by being held at 10 to about 148° C. (50° F. to about 298° F.), preferably 21.1 to 32.2° C. (70 to 90° F.) and pressure of 7 to 2069 preferably 448 to 662, more preferably 552 to 662, most preferably 634 kPa until it cools below the glass transition temperature of the polycarbonate. Optionally, in the course of press bonding texture may be applied to one or both surfaces of the sheet or laminate.

Figure 1:
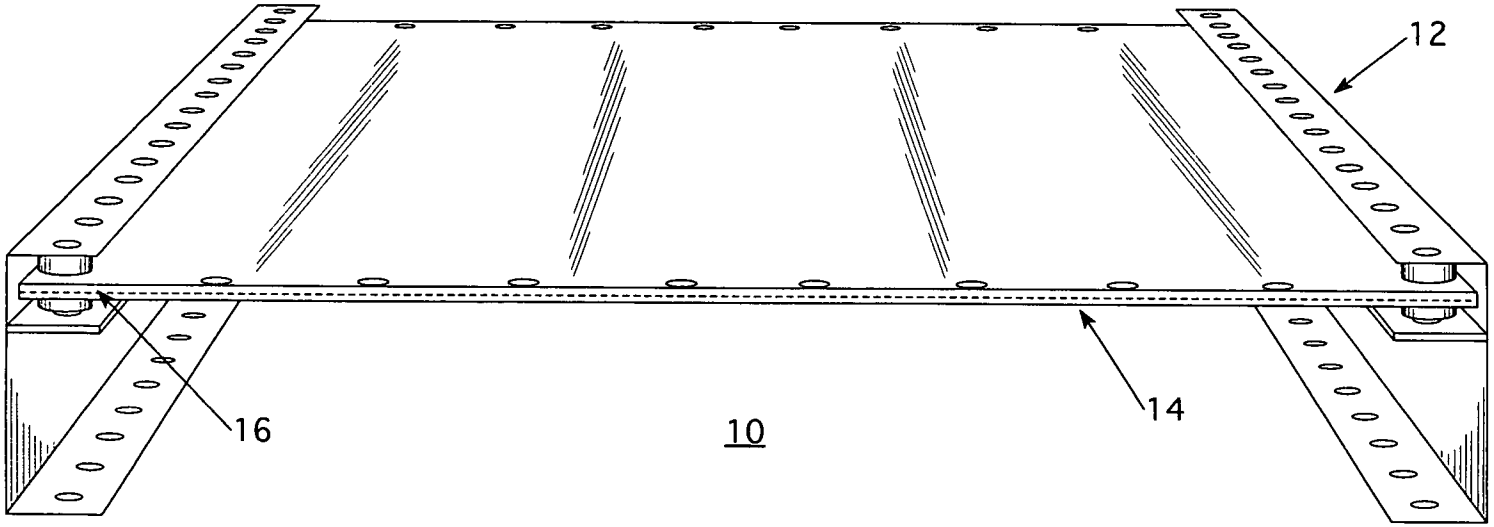
FIG. 1 shows the a laminate mounted according to the inventive method.
Figure 2:
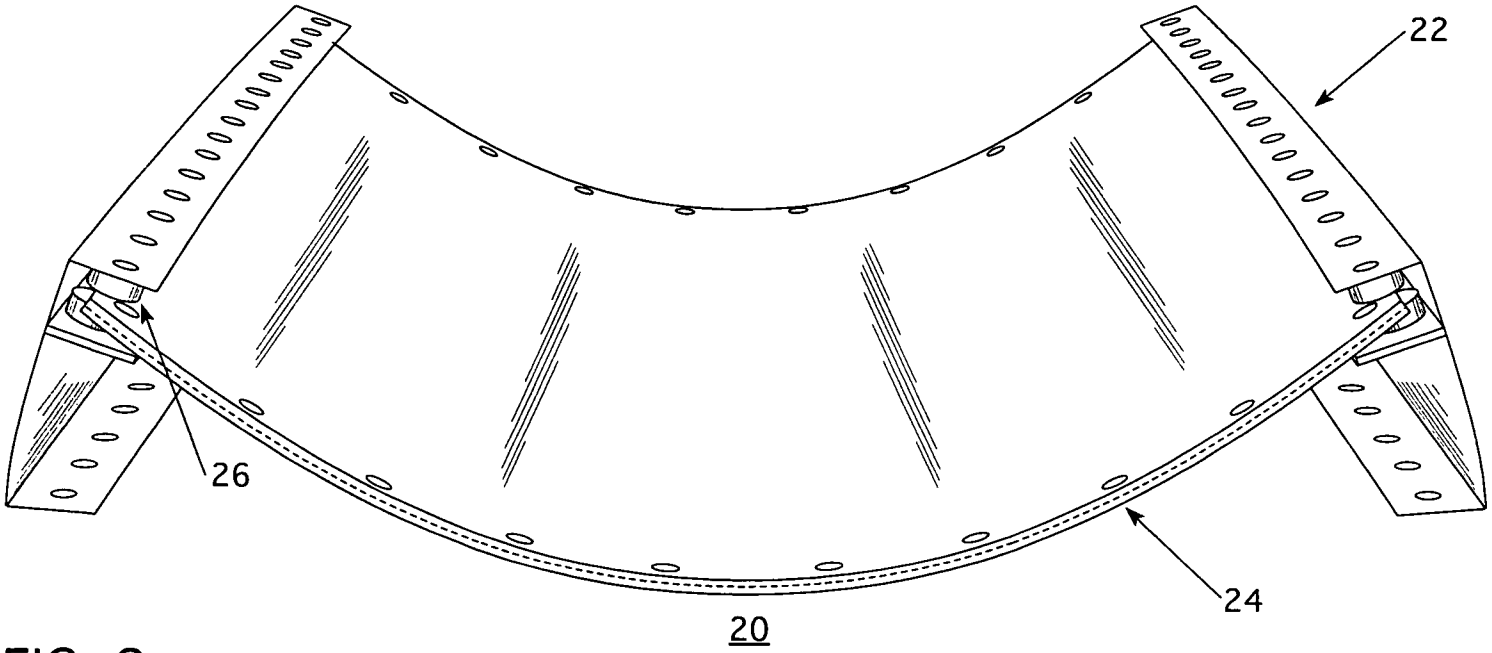
FIG. 2 illustrates the same laminate from FIG. 1 in a flexed position as it would be during a high energy impact.

The inventive method involves mounting a rectangular-shaped, monolithic polycarbonate sheet or laminate, shown in FIGS. 1 and 2 as elements 14 and 24, respectively, in a semi-rigid metallic frame along the two longer parallel sides of the rectangular-shaped sheet with the two shorter parallel sides being unconstrained. In the case of a square, two parallel sides are supported in the semi-rigid frame, and the other two parallel sides are unconstrained. The semi-rigid frame utilizes cylindrically shaped hardware (ie. bolts, rivets, studs, etc.) to hold the sheet. The semi-rigid frame is designed, via section and material properties, to flex and hinge about fixed mounting points along the length of the frame.

The metal frame to which the sheet or laminate is semi-rigidly attached is preferably made of carbon steel, i.e. steels having up to about two percent carbon content, stainless steel or aluminum. For increased durability and aesthetic appeal, frames of carbon steel may be treated with corrosion resistant coatings and/or paints. Stainless steels are preferred for outdoor applications because they are more resistant to rusting and staining than carbon and low alloy steels, thus maintaining their aesthetic appeal. It is imperative that in the instances where the image layer is capable of absorbing moisture, the edges of the sheet or laminate are sealed to prevent wicking. Suitable sealing may be by the application of silicone or by gluing to the edge a thin polymeric film, e.g. polycarbonate film.

The metal frame is made from shaped members (e.g., a "C" cross section shaped member) providing sufficient stiffness and strength to absorb the external forces applied by the blast without major distortion as shown in FIGS. 1, 2 and 3, elements 12, 22 and 32 respectively. The frame may be extended vertically at its bottom so that the extensions can be embedded in reinforced concrete foundation. As an alternative, the metal frame may be attached to the steel skeleton of the target (e.g. building) in a manner to dissipate the shock wave. Horizontal, tubular elements may also be used to attach the metal frame to the target. Such tubular elements may optionally be filled with polyurethane foam to provide the barrier/frame with additional energy dissipation capacity.

The sheet or laminate may be attached to the metal frame by a plurality of bolts rivets, studs etc. Bolts, shown in FIGS. 1, 2 and 3 as elements 16, 26 and 36 respectively, preferably shoulder bolts, may be 0.75 to 1.25 inches, more preferably 1.0 inch in diameter, with flat heads so that upon tightening, the bolt head and nut place the area of the sheet or laminate around the bolt hole in compression without creating cracks or notches. The bolts may preferably be spaced 6 inches to 24 inches apart and offset approximately 1.0 inch to 1.5 inches from the sheet or laminate edge. The bolt holes in the sheet or laminate are preferably produced with smooth, elongated edges to allow for thermal expansion and to mitigate stress. Rubber or elastomeric washers or spacers are preferably used between the sheet or laminate and the frame to further absorb impact energy and dampen forces transmitted to the building.

The mechanical properties for the "C" section metal channels preferably exhibit a final yield strength in tension of approximately 300 MPa. Otherwise, for higher or lower modulus materials such as aluminum, equivalent section properties are preferably followed through use of thicker or thinner walls. Overall, the sheet or laminate in the inventive method is preferably placed at a distance of at least 12 inches from the surface of the protected target to avoid the polycarbonate barriers striking the building while bending as a result of being hit with the shock wave resulting from a blast. Shorter distances may be used for lower threat levels or smaller panels.

This inventive method allows polycarbonate sheet or laminate to be used in high energy impact applications such as blast-mitigating building facades/windows and hurricane resistant panels. Referred to herein as a bi-active framing method, it implies that the mounts are active (or flexing) in a biaxial or two sided mode, while the other two sides are not active (or flexing during an impact event acting on the face of the system).

EXAMPLES

The present invention is further illustrated, but is not to be limited, by the following examples.

Figure 4:
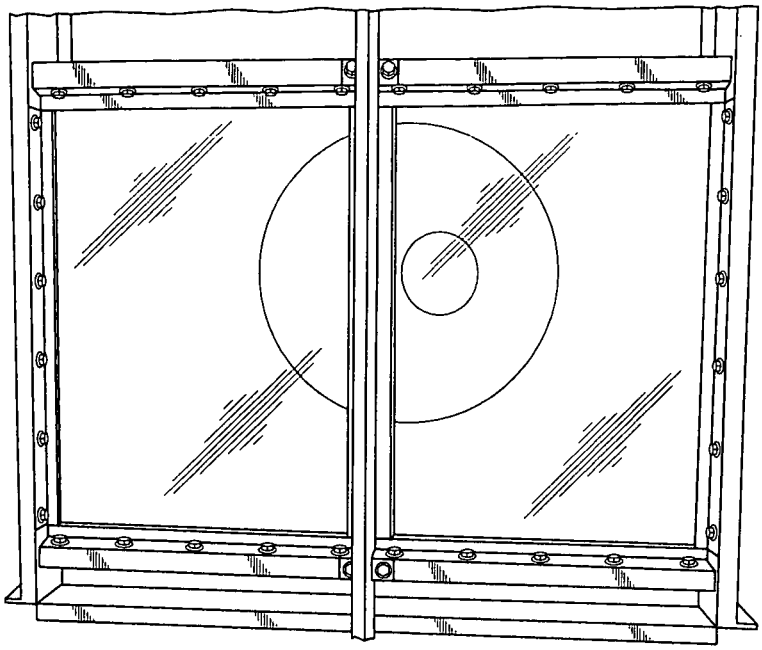
FIG. 4 shows 0.375 inch panels mounted according to prior art framing method in a shock tube test.
Figure 5:
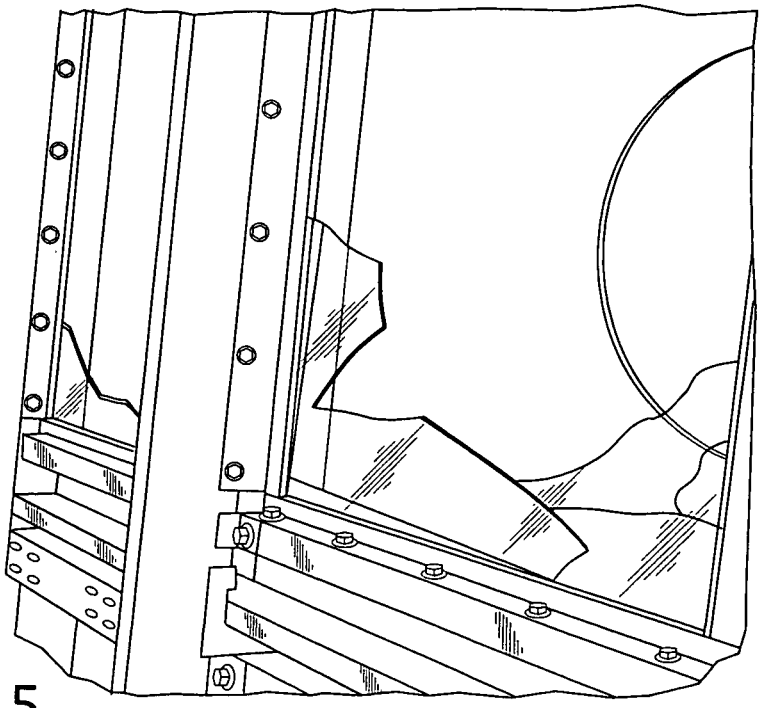
FIG. 5 shows failed 0.375 inch panels mounted according to prior art framing method.

Two 48 inch by 66 inch, 0.375 inch thick transparent monolithic polycarbonate panels were mounted to a traditional, non-active (non-flexing) frame and fastened to a shock tube as shown in FIG. 4. The polycarbonate panels were wet-glazed into the frame using an industry standard silicone. The panels both had an abrasion-resistant hard-coat applied to the surfaces. The panels were tested at near DOD (U.S. Department of Defense) loads of 6.5 psi and 61 psi-msec, pressure and impulse, respectively. Both panels failed catastrophically as shown in FIG. 5.

Figure 6:
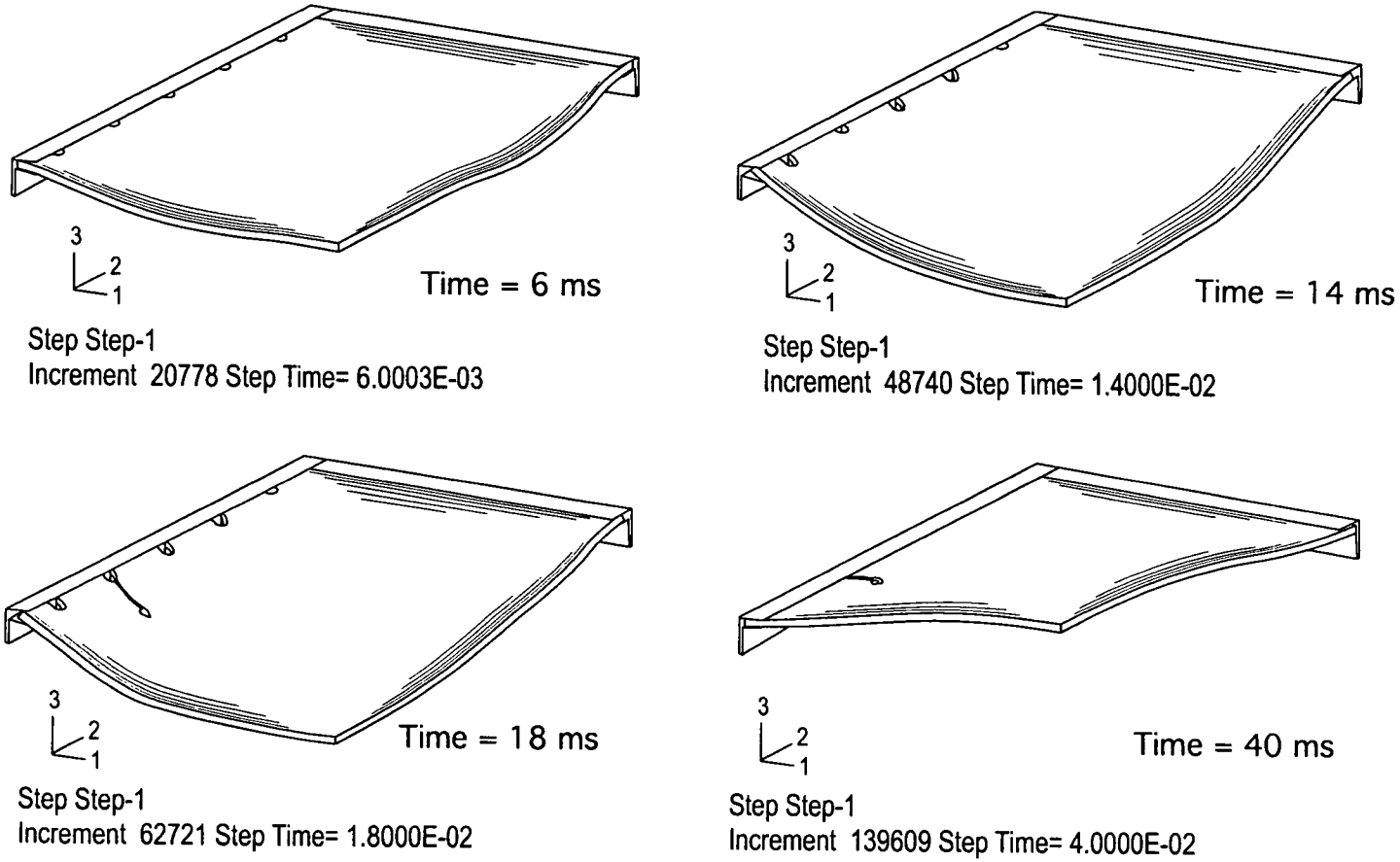
FIG. 6 provides a computer simulation of a 0.375 inch panel mounted according to the inventive method under DOD loading.

However, when the same panels were mounted according to the inventive bi-active framing method where the two longer sides were attached through cylindrical hardware to semi-rigid (flexing) metal frame sections, computer simulation predicted only a minor crack in the panel, as shown in FIG. 6 (a quarter-symmetric model). This would be considered a pass, level-2 under DOD certification, a significant improvement in performance compared to the prior art framing method.

Figure 7:
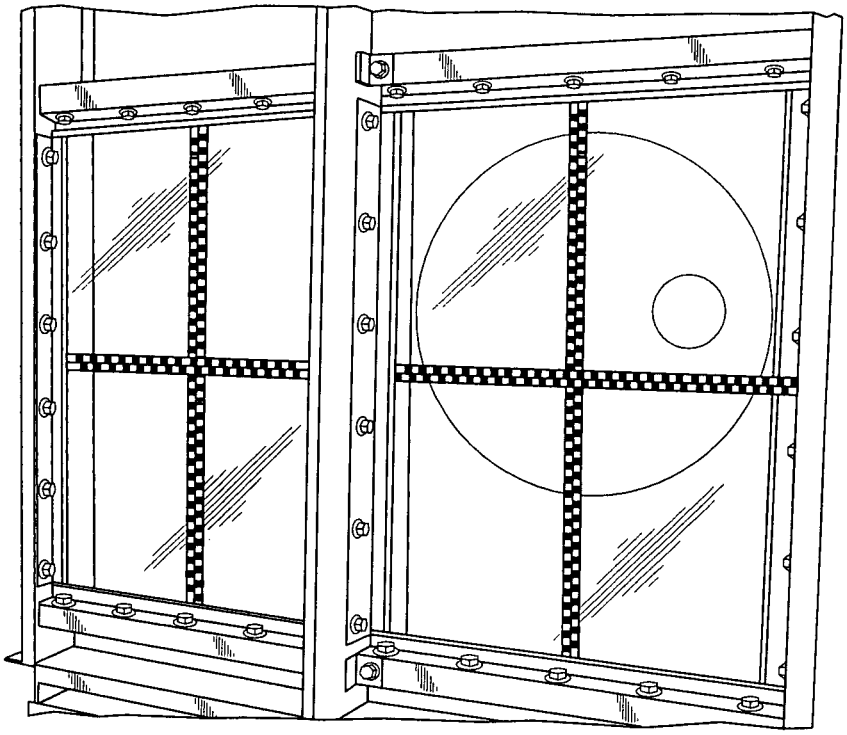
FIG. 7 shows 0.5 inch panels mounted according to prior art framing method in a shock tube test.
Figure 8:
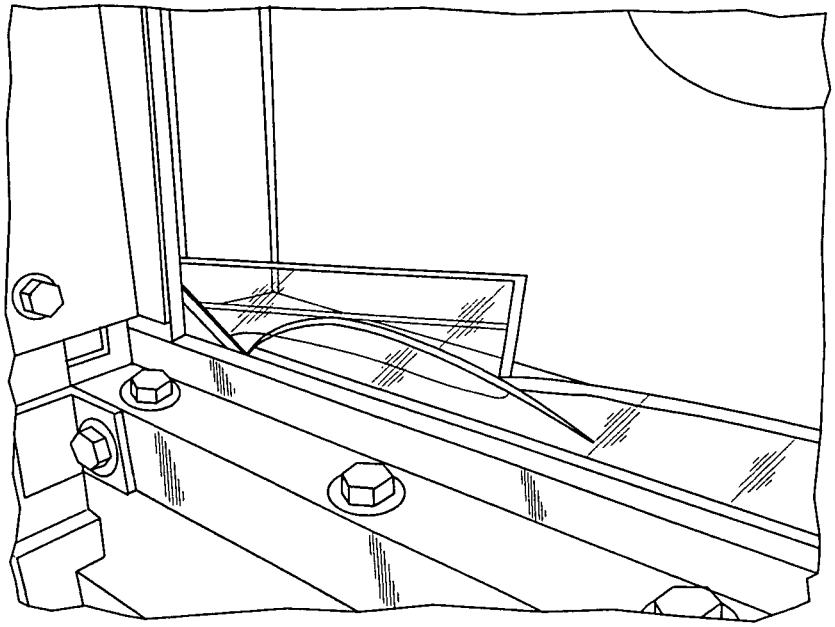
FIG. 8 shows failed 0.5 inch panels mounted according to prior art framing method.

Similarly, two 48 inch by 66 inch, 0.5 inch thick transparent monolithic polycarbonate panels were mounted to a traditional, non-active (non-flexing) frame and fastened to a shock tube as shown in FIG. 7. The polycarbonate panels were wet-glazed into the frame using a industry standard silicone. The panels both had an abrasion-resistant hard-coat applied to the surfaces. The panels were tested at near GSA-D loads of 10.7 psi and 93.8 psi-msec, pressure and impulse, respectively. Both panels failed catastrophically as shown in FIG. 8.

Figure 9:
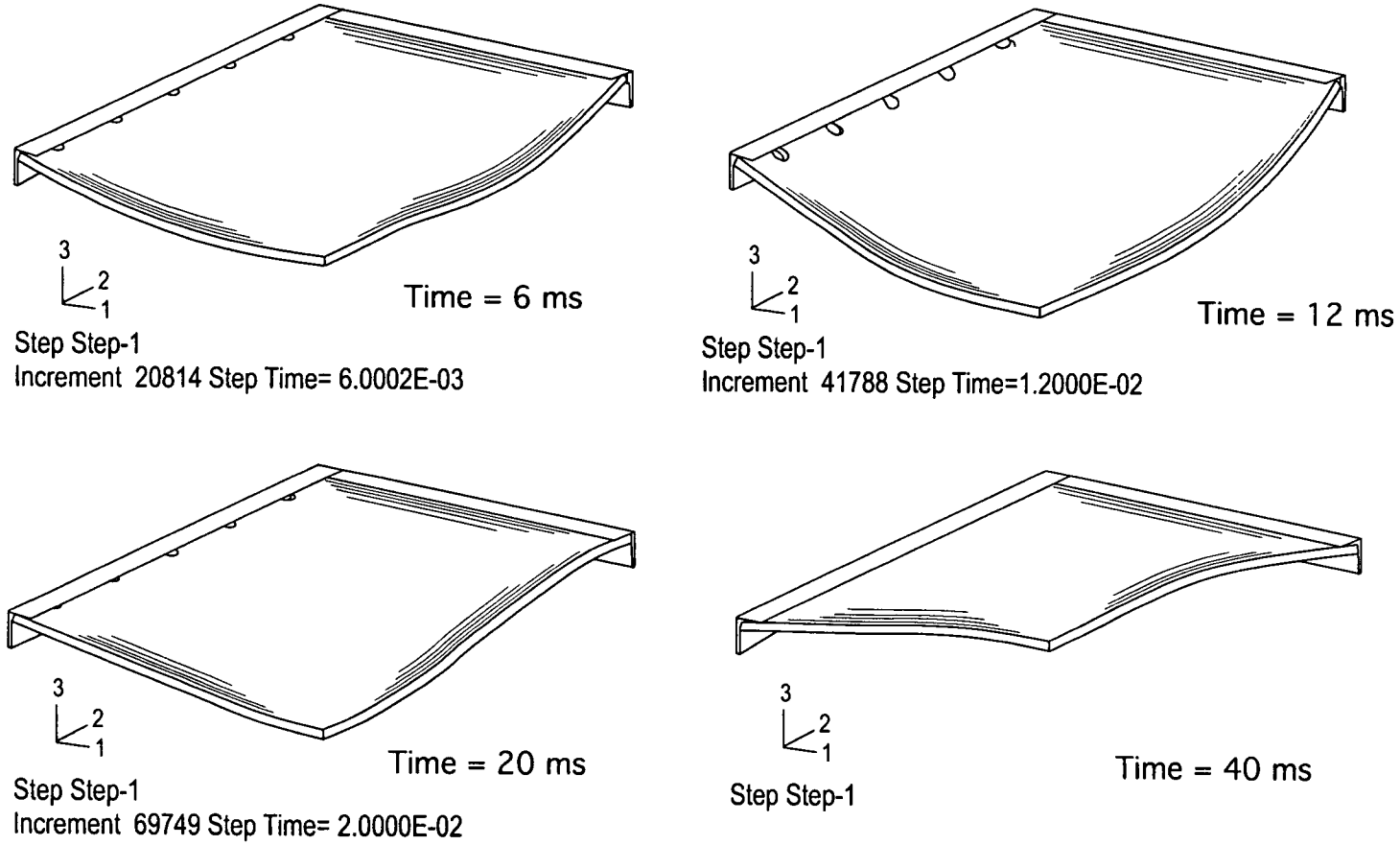
FIG. 9 provides a computer simulation of a 0.5 inch panel mounted according to the inventive method under GSA-D loading.

However, when the same panels are mounted according to the inventive bi-active framing method where the two longer sides were attached through cylindrical hardware to semi-rigid (flexing) metal frame sections, computer simulation predicted only a minor crack in the panel, as shown in FIG. 9 (a quarter-symmetric model). This would be considered a pass, level-2 under GSA ratings, a significant improvement in performance compared to the prior art framing method.

Comparisons of the prior art and inventive framing methods are shown below in Table I.

TABLE I

| Panel Gauge | Load Level | Prior art framing method** | Bi-active framing method |
|---|---|---|---|
| 0.375 | DOD | Failed | Pass, Level 2 |
| 0.375 | GSA-D | N/A | Pass, Level 3 |
| 0.375* | GSA-D | N/A | Pass, Level 2 |
| 0.5 | GSA-D | Failed | Pass, Level 2 |

*42 inch × 66 inch
**BULLETGUARD + steel "L" brackets

The foregoing examples of the present invention are offered for the purpose of illustration and not limitation. It will be apparent to those skilled in the art that the embodiments described herein may be modified or revised in various ways without departing from the spirit and scope of the invention. The scope of the invention is to be measured by the appended claims.

What is claimed is:

1. A method of mounting a blast-resistant barrier having two parallel sides comprising:
attaching the blast-resistant barrier to a semi-rigid metallic frame along two parallel sides of the barrier,
wherein the blast-resistant barrier is from about 0.375 inches to about 1.5 inches in thickness and includes at least one polycarbonate sheet,
wherein the semi-rigid metallic frame is made of one selected from the group consisting of carbon steel, stainless steel and aluminum; and
placing the blast-resistant barrier at a location between a surface of a target to be protected and a potential blast location,
wherein the blast-resistant barrier flexes in a biaxial mode,
wherein the blast-resistant barrier is capable of flexing to a pressure load of 6.5 psi and an impulse load of 61 psi-msec, and returning to its original position after flexing.

2. The method according to claim 1, wherein the blast-resistant barrier is rectangular shaped.

3. The method according to claim 1, wherein the blast-resistant barrier is square shaped.

4. The method according to claim 1 further including grounding the semi-rigid metallic frame in concrete.

5. The method according to claim 1 further including anchoring the semi-rigid metallic frame in the target to be protected.

6. The method according to claim 1 wherein the semi-rigid metallic frame has a "C" cross-section.

7. The method according to claim 1 wherein the blast-resistant barrier is attached to the semi-rigid metallic frame by a plurality of bolts.

8. The method according to claim 1, wherein the blast-resistant barrier comprises a monolithic polycarbonate sheet.

9. The method according to claim 1, wherein the blast-resistant barrier comprises a laminate including two or more polycarbonate sheets.

10. A method of mounting a blast-resistant barrier having two parallel sides comprising:
attaching the blast-resistant barrier to a semi-rigid metallic frame along two parallel sides of the barrier,
wherein the blast-resistant barrier is from about 0.375 inches to about 1.5 inches in thickness and includes at least two polycarbonate sheets having an image layer interposed between the polycarbonate sheets,
wherein the semi-rigid metallic frame is made of one selected from the group consisting of carbon steel, stainless steel and aluminum,
wherein the image layer contains at least one member selected from the group consisting of fabric, photograph, paper, wire, screen, rod, bar, grass and plant; and
placing the blast-resistant barrier at a location between a surface of a target to be protected and a potential blast location,
wherein the blast-resistant barrier flexes in a biaxial mode,
wherein the blast-resistant barrier is capable of flexing to a pressure load of 6.5 psi and an impulse load of 61 psi-msec, and returning to its original position after flexing.

11. The method according to claim 10, wherein the member is encapsulated in a polymeric resin compatible with the member and the polycarbonate.

12. The method according to claim 1 wherein at least one surface of the barrier is hard-coated.

13. The method according to claim 1 wherein at least one surface of the blast-resistant barrier is embossed.

14. The method according to claim 1, wherein the blast-resistant barrier contains a UV-stabilizer.

15. The method according to claim 1, wherein the blast-resistant barrier contains at least two polycarbonate sheets bonded one to the other by an adhesive.

16. The method according to claim 15, wherein the adhesive is thermoplastic polyurethane.

17. The method according to claim 1 further including attaching the semi-rigid metallic frame to a target to be protected by one or more hollow tubular elements.

18. The method according to claim 17, wherein the one or more hollow tubular elements is filled with polyurethane foam.

19. The method according to claim 1, wherein at least one surface of the blast-resistant barrier includes a member selected from the group consisting of a biaxially oriented polyethylene terephthalate, a polytetrafluoroethylene film, and a polyvinyl fluoride film.

20. The method according to claim 1, wherein the blast-resistant barrier further comprises a second two parallel sides that are unconstrained.

21. The method according to claim 1, wherein the blast resistant barrier is capable of flexing to a pressure load of 10.7 psi and an impulse load of 93.8 psi-msec, and returning to its original position after flexing.

22. The method according to claim 10, wherein the blast-resistant barrier further comprises a second two parallel sides that are unconstrained.

23. The method according to claim 10, wherein the blast resistant barrier is capable of flexing to a pressure load of 10.7 psi and an impulse load of 93.8 psi-msec, and returning to its original position after flexing.

* * * * *